US009254023B2

(12) United States Patent
Su et al.

(10) Patent No.: US 9,254,023 B2
(45) Date of Patent: Feb. 9, 2016

(54) PROTECTIVE COVER FOR PORTABLE ELETRONIC DEVICE

(71) Applicant: Chiun Mai Communication Systems, Inc., New Taipei (TW)

(72) Inventors: Ho-Chyuan Su, New Taipei (TW); Tzu-Cheng Yu, Santa Clara, CA (US)

(73) Assignee: Chiun Mai Communication Systems, Inc., New Taipei (TW)

( * ) Notice: Subject to any disclaimer, the term of this patent is extended or adjusted under 35 U.S.C. 154(b) by 22 days.

(21) Appl. No.: 14/014,694

(22) Filed: Aug. 30, 2013

(65) Prior Publication Data

US 2014/0216953 A1 Aug. 7, 2014

(30) Foreign Application Priority Data

Feb. 5, 2013 (CN) ..... 2013 1 0045047

(51) Int. Cl.

| | |
|---|---|
| ***B65D 85/00*** | (2006.01) |
| ***H04M 1/00*** | (2006.01) |
| ***H04M 9/00*** | (2006.01) |
| ***A45C 11/00*** | (2006.01) |

(52) U.S. Cl.

CPC ..... *A45C 11/00* (2013.01); *A45C 2011/002* (2013.01); *A45C 2011/003* (2013.01); *A45F 2200/0516* (2013.01); *A45F 2200/0525* (2013.01)

(58) Field of Classification Search

CPC ... A45C 2013/025; A45C 13/02; G06F 1/628

USPC ..... 206/320, 305, 38, 234, 579; 455/575.8; 379/433.11; D3/218, 269; 361/679.01, 361/679.02

See application file for complete search history.

(56) References Cited

U.S. PATENT DOCUMENTS

| | | | | | |
|---|---|---|---|---|---|
| 4,075,702 | A | * | 2/1978 | Davies | 708/106 |
| 5,195,634 | A | * | 3/1993 | Zaug | 206/320 |
| 5,583,742 | A | * | 12/1996 | Noda et al. | 361/679.21 |
| 5,648,757 | A | * | 7/1997 | Vernace et al. | 340/539.32 |
| 6,196,405 | B1 | * | 3/2001 | Kambouris | 220/4.22 |
| 6,616,111 | B1 | * | 9/2003 | White | 248/309.1 |
| 6,995,976 | B2 | * | 2/2006 | Richardson | 345/173 |
| 7,016,185 | B2 | * | 3/2006 | Chen et al. | 361/679.4 |
| D551,846 | S | * | 10/2007 | Ko et al. | D3/201 |
| D551,856 | S | * | 10/2007 | Ko et al. | D3/218 |
| D654,901 | S | * | 2/2012 | Tsai et al. | D14/138 G |
| D657,332 | S | * | 4/2012 | Veiga et al. | D14/138 G |
| D671,086 | S | * | 11/2012 | Yu et al. | D14/138 G |
| D671,932 | S | * | 12/2012 | Azoulay | D14/250 |
| 8,342,325 | B2 | * | 1/2013 | Rayner | 206/320 |
| D680,092 | S | * | 4/2013 | Tsai et al. | D14/138 G |
| D682,239 | S | * | 5/2013 | Yeh et al. | D14/138 G |
| 8,584,847 | B2 | * | 11/2013 | Tages et al. | 206/320 |
| D700,163 | S | * | 2/2014 | Huang et al. | D14/138 G |
| D704,684 | S | * | 5/2014 | Yeh et al. | D14/248 |
| D704,685 | S | * | 5/2014 | Yeh et al. | D14/248 |
| D705,199 | S | * | 5/2014 | Huang et al. | D14/238.1 |

(Continued)

*Primary Examiner* — J. Gregory Pickett
*Assistant Examiner* — Jennifer N Zettl
(74) *Attorney, Agent, or Firm* — Novak Druce Connolly Bove + Quigg LLP

(57) ABSTRACT

A protective cover for a portable electronic device includes a main body and a plurality of cushioning structures. The main body is configured to receive the portable electronic device. Each cushioning structure includes an elastic body protruding from the main body and a clearance defined between the main body and the elastic body. The elastic body is deformed toward the clearance when the elastic body is impacted.

8 Claims, 1 Drawing Sheet

(56) References Cited

U.S. PATENT DOCUMENTS

| | | | | |
|---|---|---|---|---|
| 2002/0079244 | A1* | 6/2002 | Kwong | 206/305 |
| 2005/0247584 | A1* | 11/2005 | Lu | 206/320 |
| 2008/0053851 | A1* | 3/2008 | Ko et al. | 206/320 |
| 2008/0053852 | A1* | 3/2008 | Ko et al. | 206/320 |
| 2009/0230006 | A1* | 9/2009 | Pidgley et al. | 206/320 |
| 2010/0203931 | A1* | 8/2010 | Hynecek et al. | 455/575.8 |
| 2011/0192743 | A1* | 8/2011 | May et al. | 206/320 |
| 2012/0261289 | A1* | 10/2012 | Wyner et al. | 206/320 |
| 2012/0327565 | A1* | 12/2012 | Tages et al. | 361/679.01 |
| 2013/0296004 | A1* | 11/2013 | Tages et al. | 455/575.8 |
| 2013/0331155 | A1* | 12/2013 | Tages et al. | 455/575.8 |
| 2014/0076753 | A1* | 3/2014 | Limber et al. | 206/320 |

* cited by examiner

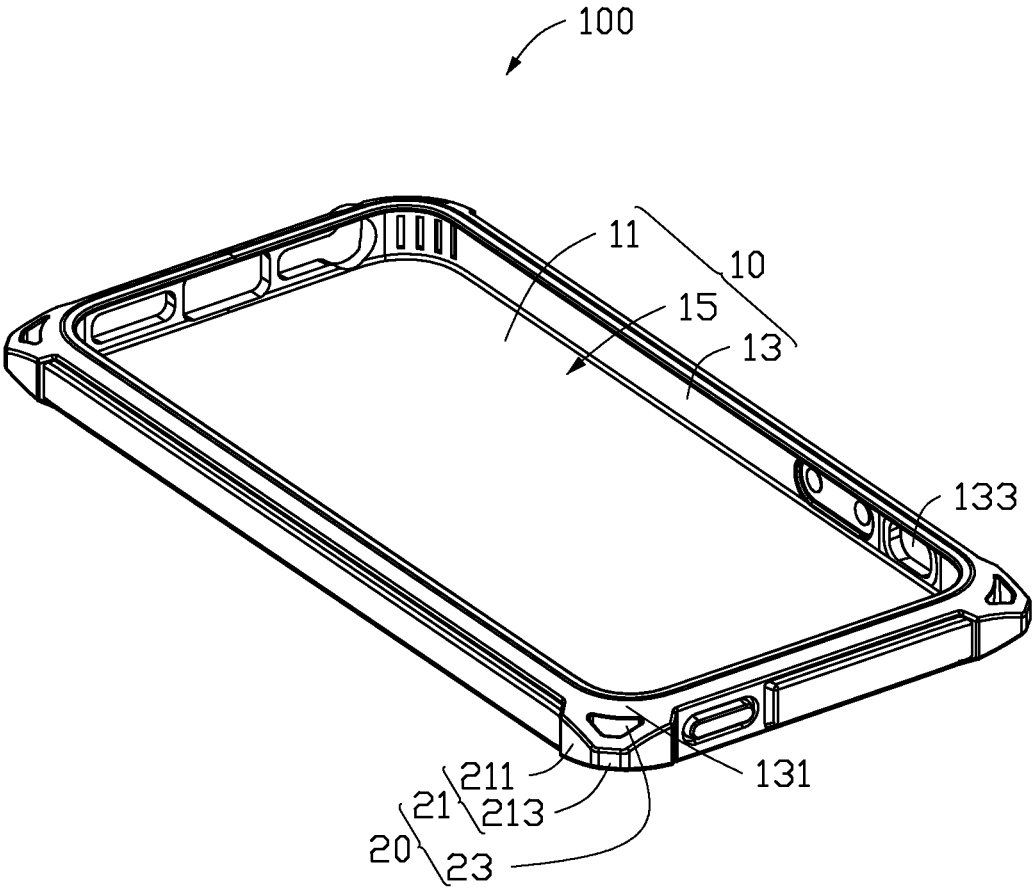
100
11
10
15
13
133
131
211
21
213
20
23

PROTECTIVE COVER FOR PORTABLE ELETRONIC DEVICE

BACKGROUND

1. Technical Field

The exemplary disclosure generally relates to protective covers, and particularly to a protective cover for a portable electronic device.

2. Description of Related Art

In order to protect a housing of a portable electronic device, a protective cover can be used. The protective cover protects the portable electronic device from being stained or scraped. However, if the portable electronic device is dropped, the protective cover may not completely cushion the impact, which could cause damage to electronic components of the portable electronic device.

Therefore, there is room for improvement within the art.

BRIEF DESCRIPTION OF THE DRAWINGS

Many aspects of the embodiments can be better understood with reference to the drawings. The components in the drawings are not necessarily drawn to scale, the emphasis instead being placed upon clearly illustrating the principles of the disclosure.

FIG. 1 shows an isometric view of an exemplary embodiment of a protective cover.

DETAILED DESCRIPTION

FIG. 1 shows an isometric view of an exemplary embodiment of a protective cover 100. The protective cover 100 is used to protect a portable electronic device (not shown), such as a mobile phone, or a tablet computer, for example. The protective cover 100 includes a main body 10 and a plurality of cushioning structures 20. The main body 10 is configured to cover the portable electronic device. The protective cover 100 is preferably made of elastic materials, such as thermoplastic polyurethane(TPU). The main body 10 and the cushioning structures 20 are integrally formed together.

The main body 10 includes a bottom wall 11, a peripheral wall 13 protruding from an peripheral edge of the bottom wall 11, and a receiving groove 15 surrounded by the bottom wall 11 and the peripheral wall 13. The receiving groove 15 receives the portable electronic device. In another embodiment, the bottom wall 11 can be omitted, and the peripheral wall 13 encloses the portable electronic device. The peripheral wall 13 includes a plurality of corners 131, and defines a plurality of through holes 133. The through holes 133 expose keys and interfaces of the portable electronic device.

The cushioning structures 20 are arranged corresponding to the corners 131 of the main body 10. Each cushioning structure 20 includes an elastic body 21 protruding from the main body 10 and a clearance 23 defined between the elastic body 21 and the corner 131. The elastic body 21 can be deformed toward the clearance 23 when the elastic body 21 is impacted, such that a concussion force to the portable electronic device which is received in the protective cover 100 is decreased. The elastic body 21 is positioned at an outer side of a corresponding corner 131. The elastic body 21 is preferably wedge-shaped. In particular, each elastic body 21 includes two elastic arms 211 connected to each other. A distal end of each elastic arm 211 is connected to the corner 131. A width of each elastic arm 211 is gradually decreased from the distal end to the junction between the two elastic arms 211. A plane 213 is defined at the junction between two elastic arms 211 opposite to the corner 131. The plane 213 is configured to increase an area of thrust surface of the cushioning structure 20, to improve the cushion effect of the cushioning structure 20. In the exemplary embodiment, an angle between the two elastic arms 211 is about ninety degrees.

The clearance 23 is surrounded by the corner 131 and the two elastic arms 211. The clearance 23 is configured to facilitate the deformation of the elastic body 21. In the exemplary embodiment, the clearance 23 is a through hole. In another embodiment, the clearance 23 can be a blind hole defined in the elastic body 21.

In use, the portable electronic device is received in the protective cover 100, when the portable electronic device is dropped, the elastic body 21 is impacted and thus is deformed toward the clearance 23 to cushioning concussion exerted on the portable electronic device. Therefore, the electronic components in the portable electronic device can be protected from the concussion.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A protective cover for a portable electronic device, comprising:

a main body configured to receive the portable electronic device and comprising a peripheral wall that comprises a plurality of corners and a plurality of cushioning structures arranged corresponding to the plurality of corners, each cushioning structure comprising an elastic body protruding from the main body and a clearance defined between the main body and the elastic body, the elastic body comprising:

elastic arms connected to each other, wherein a distal end of each of the arms is connected to a corresponding corner of the plurality of corners, the clearance is surrounded by the elastic two arms and the corner, the elastic arms deformable toward the clearance when the elastic arms are impacted; wherein the clearance is a blind hole.

2. The protective cover of claim 1, wherein an angle between the two elastic arms is approximately ninety degrees.

3. The protective cover of claim 1, wherein the cushioning structures are integrally formed with the main body, the protective cover is made of elastic. material.

4. The protective cover of claim 1, wherein the peripheral wall defines a plurality of through holes that expose keys and interface of the portable electronic device.

5. A protective cover for a portable electronic device, comprising:

a main body configured to receive the portable electronic device comprising a peripheral wall that comprises a plurality of corners and a plurality of cushioning structures structure positioned at the main body and arranged corresponding to the plurality of corners, each cushioning structure comprising an elastic body protruding from the main body and a clearance defined between the main body and the elastic body;

wherein each elastic body comprises elastic arms connected to each other, a distal end of each of the elastic arms is connected to a corresponding corner, the clearance is surrounded by the elastic arms and the corner; the elastic arms are deformable toward the clearance wherein the clearance is to blind hole.

6. The protective cover of claim 5, wherein an angle between the two elastic arms is approximately ninety degrees.

7. The protective cover of claim 5, wherein the cushioning structures are integrally formed with the main body, the protective cover is made of elastic material.

8. The protective cover of claim 5, wherein the peripheral wall defines a plurality of through holes that expose keys and interface of the portable electronic device.

* * * * *